US007862484B1

(12) United States Patent
Coffey

(10) Patent No.: US 7,862,484 B1
(45) Date of Patent: Jan. 4, 2011

(54) FOLDING EXERCISE ROWING MACHINE

(76) Inventor: Calvin T. Coffey, 2820 County Rd. 21, Watkins Glen, NY (US) 14891

( * ) Notice: Subject to any disclaimer, the term of this patent is extended or adjusted under 35 U.S.C. 154(b) by 0 days.

(21) Appl. No.: 12/611,571

(22) Filed: Nov. 3, 2009

(51) Int. Cl.
*A63B 69/08* (2006.01)

(52) U.S. Cl. ..... 482/72

(58) Field of Classification Search ..... 482/62–64, 482/51, 92, 95–96, 82, 53, 126, 72–73, 63, 482/57; 280/225–224, 245, 246, 254, 258; 440/101

See application file for complete search history.

(56) References Cited

U.S. PATENT DOCUMENTS 3,266,801 A * 8/1966 Johnson ..... 482/73
4,421,307 A * 12/1983 Cunnington et al. ..... 482/72
4,743,011 A * 5/1988 Coffey ..... 482/73
4,846,460 A * 7/1989 Duke ..... 482/73
4,880,224 A * 11/1989 Jonas et al. ..... 482/72
4,884,800 A * 12/1989 Duke ..... 482/73
5,441,469 A * 8/1995 Chern ..... 482/72
5,512,027 A * 4/1996 Chen ..... 482/72
5,547,444 A * 8/1996 Huang ..... 482/72
5,569,130 A * 10/1996 Wang et al. ..... 482/96
5,575,741 A * 11/1996 Fan ..... 482/72
5,779,600 A * 7/1998 Pape ..... 482/72
5,928,116 A * 7/1999 Chiang ..... 482/72
6,817,968 B2 * 11/2004 Galbraith et al. ..... 482/72
6,926,647 B1 * 8/2005 Huang et al. ..... 482/72
7,022,052 B1 * 4/2006 Lai ..... 482/72
7,115,077 B2 * 10/2006 Yang ..... 482/73
7,229,388 B2 * 6/2007 Yang ..... 482/72
7,500,938 B2 * 3/2009 Fan ..... 482/72
7,572,211 B2 * 8/2009 Roach ..... 482/72
7,591,766 B2 * 9/2009 Ellis ..... 482/72
2005/0272568 A1 * 12/2005 Wang et al. ..... 482/72

* cited by examiner

*Primary Examiner*—Lori Baker
(74) *Attorney, Agent, or Firm*—Bernhard P. Molldrem, Jr.

(57) ABSTRACT

A folding exercise rowing or sculling machine has left and right fold-down oar assemblies, each formed of an arm hinged to the side of the frame, and a pivot at the end of the arm on which the oar and oarlock are mounted. A cam plate at a lower end of the pivot pulls a cable that drives the sprocket wheel of a flywheel mounted to the rear or proximal of the frame. The oar assemblies fold to rearward, with the cam wheels fitting in a space between the flywheel and the frame. Multiplier pulley assemblies couple the power cable and elastic cords to a drive chain that is wound around the sprocket.

15 Claims, 5 Drawing Sheets

FOLDING EXERCISE ROWING MACHINE

BACKGROUND OF THE INVENTION

This invention relates to exercise equipment, and is more particularly concerned with a exercise rowing or sculling machines. The invention is specifically directed to a rowing or sculling machine that simulates the sweeping rowing motion characteristics of a rowing or sculling shell and imparts a resistance to the pull of oars similar to what is experienced in actual rowing or sculling on the water. The invention is also concerned with a rower or rowing machine that can be folded down to a compact shape for storage, and can be opened out for use in exercise.

There are many types and styles of exercise rowing machines. One excellent example of a rowing machine that simulates the motions of actual rowing is described in Coffey U.S. Pat. No. 4,743,011. That patent also contains a discussion of many earlier rowing machines, including several that employ a flywheel with air vanes to impart resistance to the motions that simulate the stroke action of rowing.

The exercise rowing machine that is described in U.S. Pat. No. 4,743,011 employs a pair of cam members, each with an arcuate cam surface that winds up a cord or cable when an associated oar is pulled. The cable then pulls a drive chain over a sprocket to rotate a horizontal flywheel. In order to have provide a realistic resistance from the flywheel, the cam members have a radius of about two to three feet. The oars and cams are supported on arms or crossbars that project out to the left and right sides of the frame of the rowing machine. The machines of this construction tend to have a large "footprint" and take up considerable space when they are not in use. The machines are difficult to store also, unless the machine is disassembled.

OBJECTS AND SUMMARY OF THE INVENTION

Accordingly, it is an object of this invention to provide a rowing or sculling exercise machine that provides excellent simulation of rowing or sculling stroke action, but which overcomes the drawbacks of the prior art.

It is another object to provide an exercise rowing machine that can be easily and quickly folded down for storage, and can be just as easily folded out to an open condition for exercise use.

It is a further object to provide an exercise rowing machine that is more compact than earlier rowing machines that simulate realistic stroke action, and which nevertheless provide sufficient resistance for exercise and training purposes.

In accordance with an aspect of the present invention, a fold-down exercise rowing machine is formed of an elongated frame that has proximal and distal ends, and left and right sides. There are a pair of seat rail members extending at least a portion of the distance between the proximal and distal ends. These can be separate parallel rails, or they can be flanges, grooves, or surfaces on the left and right sides of a single beam member, depending on the design of the unit. A foot plate or foot rest is mounted on the frame at or near the distal end. A rotary flywheel is mounted at the proximal end of the frame below the seat rail members. The flywheel is horizontal, and rotates on a vertical axis, with a drive sprocket for rotating the flywheel. Favorably, this can be a centrifugal fan. A vertical spacing is provided between the top of the flywheel and the underside of the seat rail members.

A sliding seat is supported on the seat rail members and is adapted to roll or glide along the seat rail members.

A pair of transverse arms are mounted on the frame, and these are pivotally connected onto the left and right sides of the frame. The transverse arms pivot between an extended position in which the arms protrude horizontally out from the frame, and a withdrawn position in which the arms lie parallel to and alongside the frame. Pivot sleeves are affixed at outer ends of the arms, to define vertical pivot axes, and left and right oar pivot members are rotatably supported in the pivot sleeves. Left and right elongated rower oar handles, that is, shafts, are attached onto upper ends of the pivot members. These rotate the pivot members, but may have a degree of freedom up-and-down, and may also have some rotational freedom on the shaft axis to permit a feathering action.

Left and right cam members are mounted onto lower ends of the pivot members, and each has an arcuate cam face containing a cable groove. These are used for pulling right and left flexible, but inextensible cables that are attached to the cam members and which ride in the cable groove. Instead of the arcuate cams, other equivalent cable pulling members may be used here. The power cables are components of a power cable arrangement that also includes a drive chain that winds around the drive sprocket of the flywheel. The motion of the cable arrangement rotates the flywheel when a user, seated on the sliding seat, strokes one or both of the oar handle shafts. An elastic cord or equivalent resilient return means applies a tension onto the power cable arrangement against the stroke action of the oar or oars.

There are releasable latches that hold the transverse arms in their extended position during exercise use of the machine, but these are adapted to be released, and to permit the arms to swing rearwardly to their withdrawn position after use. The two cam members each have a thickness less than the vertical spacing between the flywheel and the rail members above it on the frame, and this permits the cam members to fit in the space between the flywheel and the seat rail members when the arms are in their withdrawn position, i.e., positioned alongside the frame.

Preferably the transverse arms each have an associated hinge member affixed to an inner end of the arm and a corresponding hinge part that is affixed to the respective side of the frame and situated at a proximal (i.e., rear) side of the associated arm. This configures the arms to swing to rearward so the cam members move into place above the flywheel.

Favorably, the cam members can generally take the form of a sector of a disk with the cam face thereof being substantially an arc of a circle. The cam members can have a smaller radius than that of the rowing machine discussed earlier, and may have a radius of about nine inches. The cam face may be shaped somewhat acircular to achieve a desired pull characteristic.

The power cable arrangement includes a multiplier pulley arrangement that is situated between the power cable(s) and the drive chain that winds around the drive sprocket. The multiplier pulley arrangement imparts a motion multiplier effect, e.g., of 4:1, to the drive chain. The return means e.g., the an elastic member which anchored to said frame, can also have an associated multiplier pulley connected with the other end of the drive chain, and may favorably impart a motion multiplier effect of 4:1.

The above-described rowing machine configuration is favorably fitted with a flywheel of the type that is in the form a centrifugal blower wheel having vanes distributed around its vertical axis.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
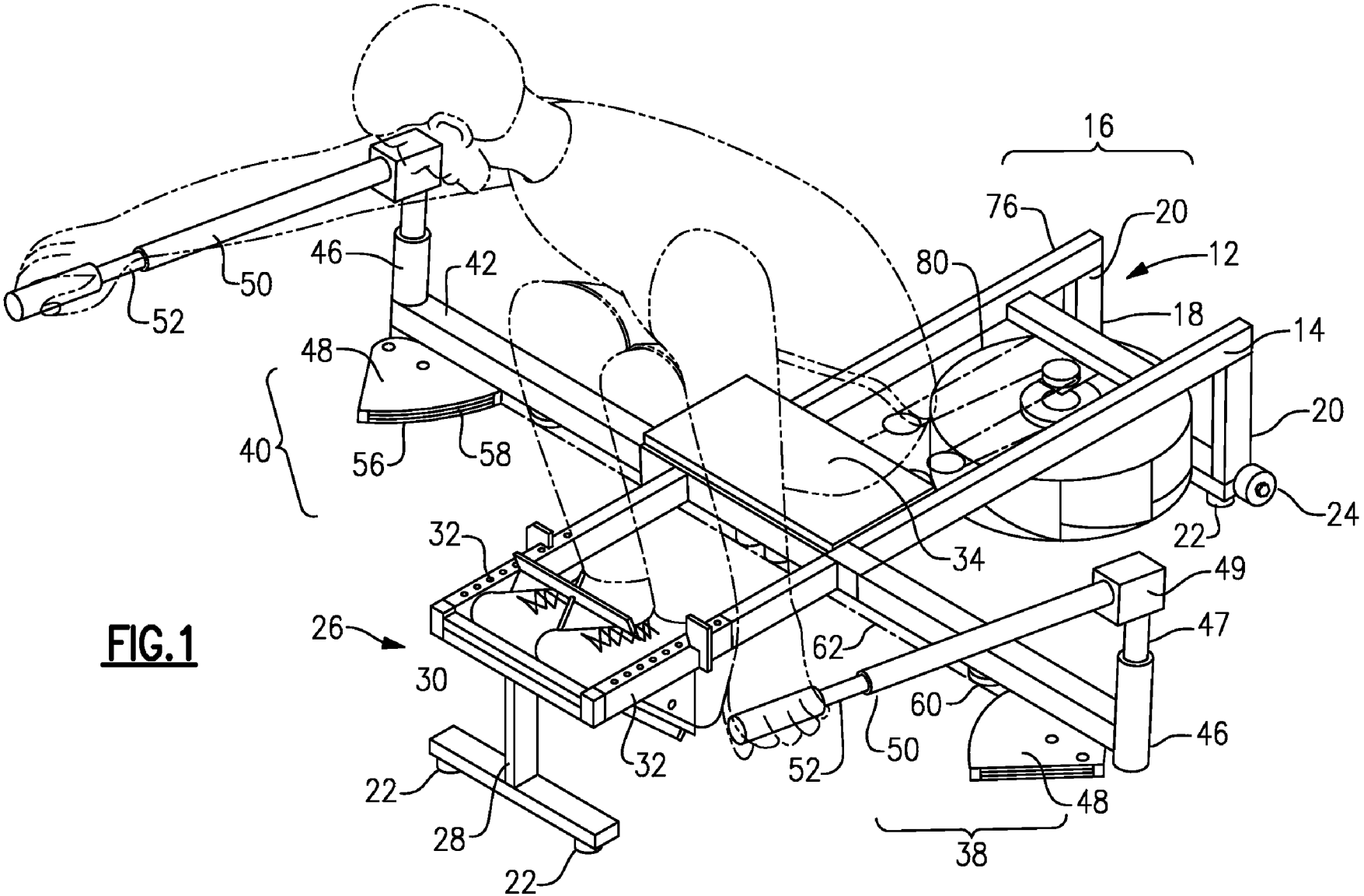
FIG. 1 is a perspective view of the rowing machine according to an embodiment of this invention.
Figure 6:
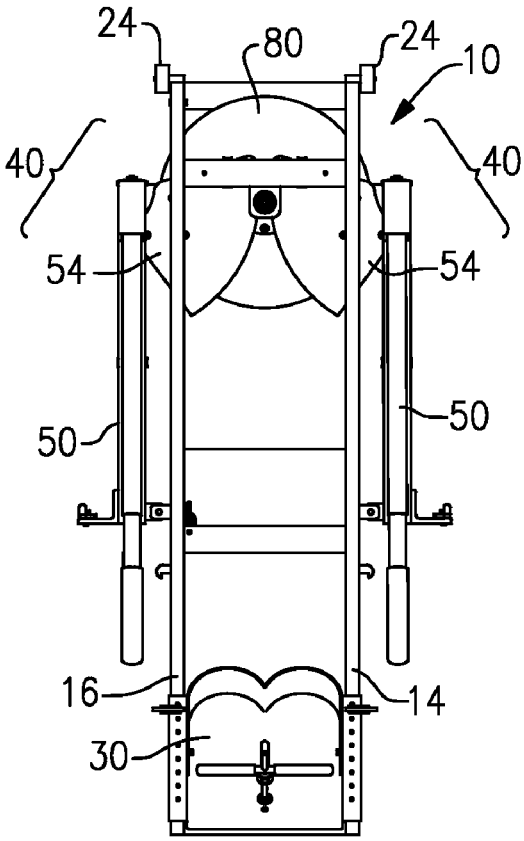
FIGS. 6, 7, and 8 are top plan, left side elevation, and front elevation views thereof, showing the oar assemblies thereof in the folded or withdrawn position.
Figure 7:
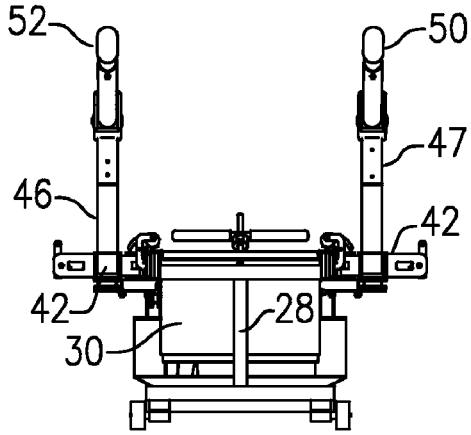
Figure 8:
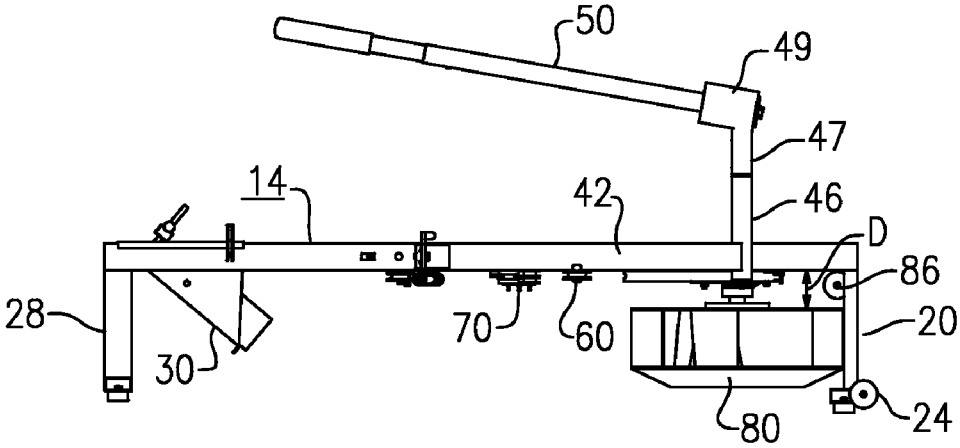

With reference to the Drawing, and initially to FIG. 1, and with additional reference to FIGS. 2, 3, 4 and 5, an exercise rowing machine 10 which embodies the present invention is shown in its normal use position, i.e., folded out and open. The machine 10 folded-in for storage, or to minimize the space taken up when not in use, is illustrated in FIGS. 6, 7, and 8.

The rowing machine 10 in this embodiment is formed of a frame 12, with longitudinal seat rails 14 and 16 disposed at the left and right sides of the frame. A proximal or rear end is situated behind the rower's position, with a pair of vertical risers 20, bumpers or rubber cushions 22 to contact the floor, and a pair of wheels or rollers 24 for facilitate moving the machine within the room. A distal or forward end 26 of the frame 12 has a vertical support leg 28, with bumpers 22 similar to those at the proximal end. A foot plate, i.e., stretcher or foot rest 30, is situated at the distal end, and may have heel cups and a horizontal foot bar, as shown here, for supporting the user's feet. An adjustment slide mechanism 32 is provided for adjusting the position of the foot plate 30.

A sliding seat 34 is provided for the user or rower, and has a set of flanged wheels that ride along the left and right rails 14, 16 to facilitate a realistic rowing motion during exercise use.

Approximately midway between the proximal and distal ends of the frame 12, a transverse support bar 36 extends horizontally between the left and right rails 14 and 16.

Figure 2:
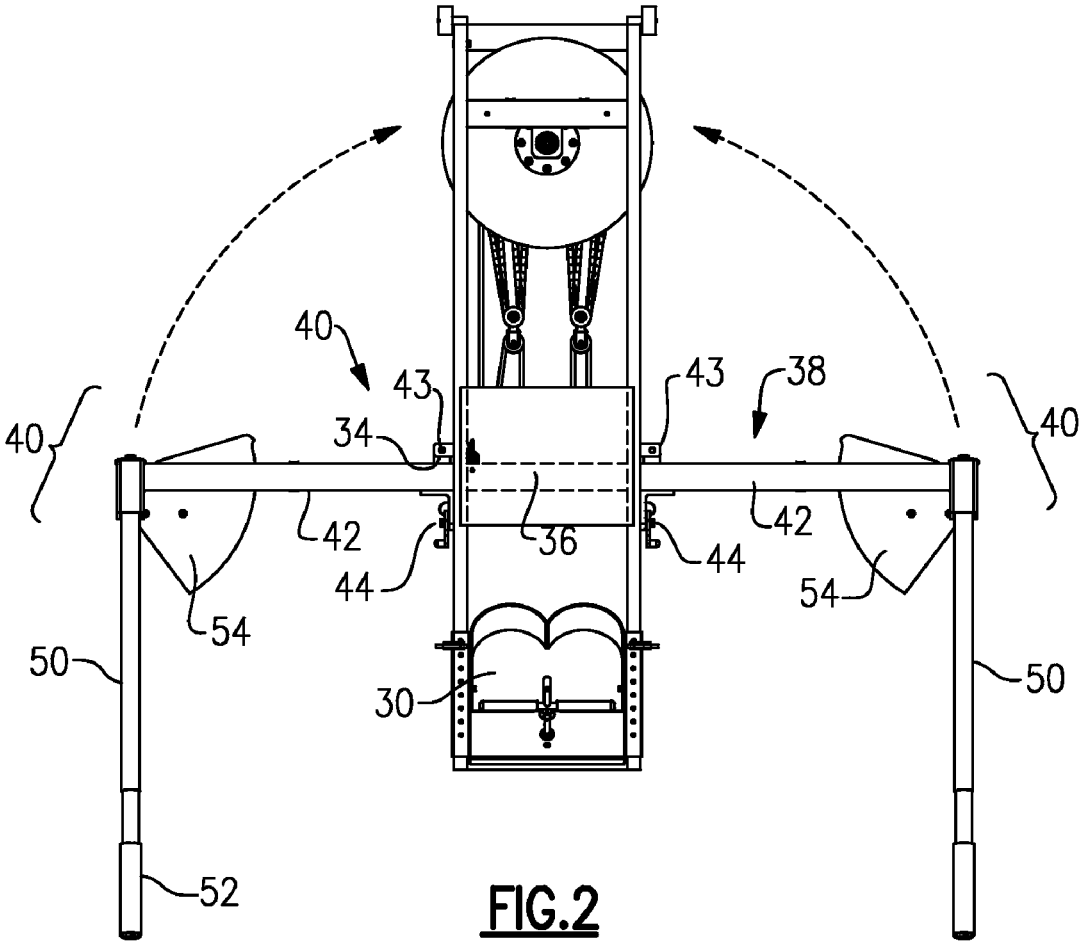
FIG. 2 is a plan view thereof.
Figure 3:
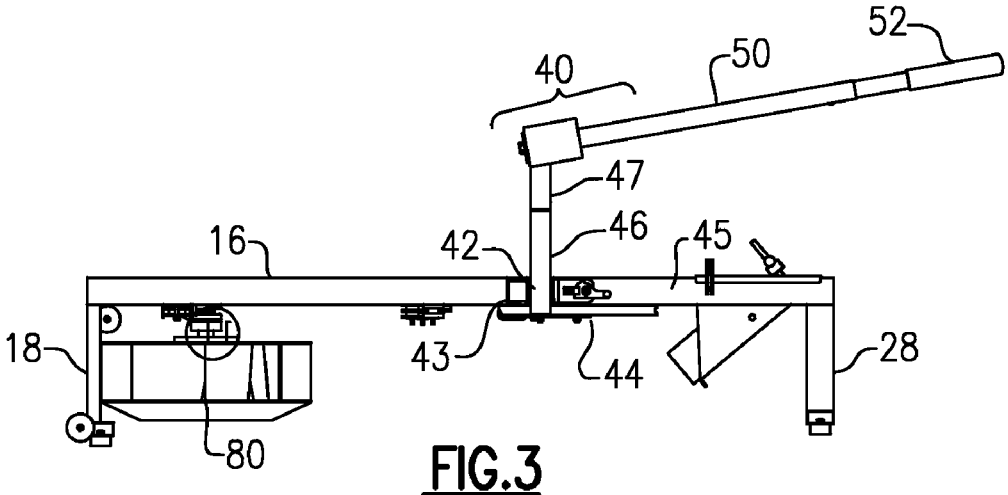
FIG. 3 is right side elevation thereof.
Figure 4:
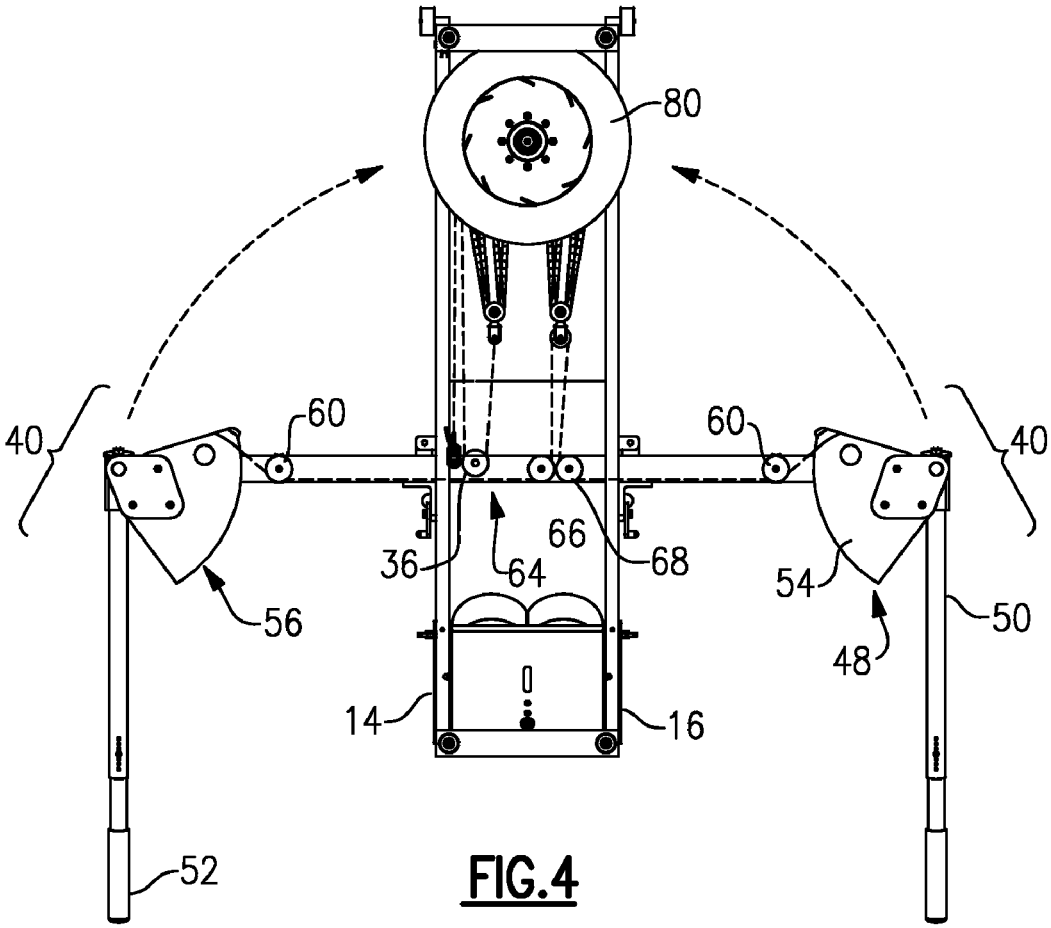
FIG. 4 is a bottom view thereof.
Figure 5:
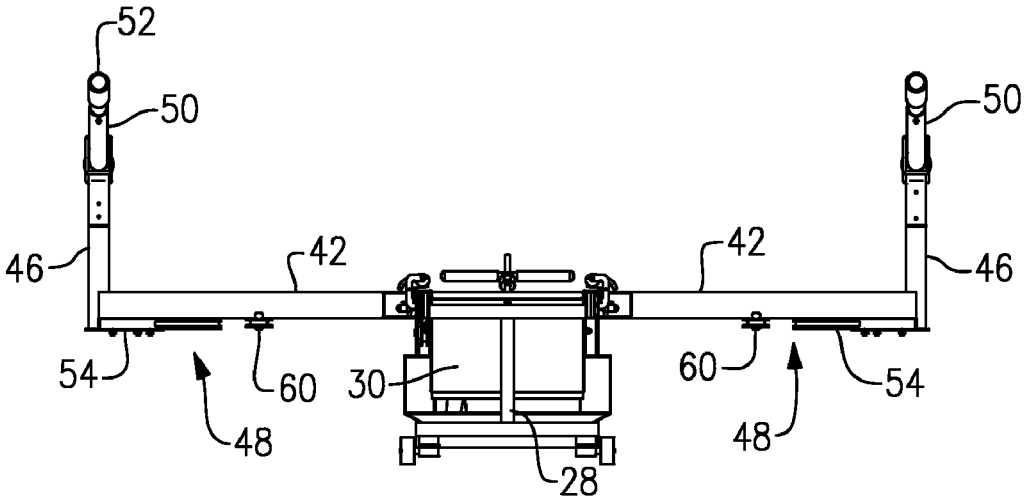
FIG. 5 is a front elevation thereof.

At the left and right sides of the frame 12 there are a left folding oar assembly 38 and a right folding oar assembly 40. In this embodiment, these assemblies 38, 40 are substantially mirror images of one another. Each such oar assembly 38 and 40 has a horizontal arm 42, i.e., a beam member, that projects horizontally out from the side of the frame 12, and has a pivot member 43 that attaches to the frame 12, here on the proximal or rearward side of the arm 42. The arms 42 are generally aligned with the horizontal transverse support bar 36. At the distal or foot side is a latch mechanism 44 that holds the arm in the illustrated extended or open position. A cam lever 45 is mounted on each side of the frame 12 and is used for closing and locking the latch mechanism. The cam lever can be lifted to release the associated latch so the arm 42 can be folded forwards. In FIGS. 2 and 4, the dash line arcs illustrate the motion of the oar assemblies 40 to their closed or folded position.

At the outer end of each of the arms 42 a vertical pivot sleeve 46 is affixed, e.g., welded. A pivot post 47 is held here, and is provided rotational freedom. A rope cam assembly 48, generally in the shape of a sector of a disk, is supported on the pivot post 47 beneath the respective rail 14 or 16, and an oar lock 49 is affixed to the upper end of each of the pivot posts 47. Each oar lock 47 holds an elongated oar lever 50, and these are pivoted on a horizontal axis so as to enjoy at least some up-and-down freedom. Each oar lever 50 holds a handle extension 52 which permits the length of the oar to be adjusted for the rower, and can also be used to change the oar length for sweep (single oar) and scull (two oar) rowing motion. The handle extension 52 may also be rotated to simulate feathering of the oars between oar pulls.

The cam assembly 48 is here shown as having a cam plate 54 which has a thickness on the order of about one inch. On one edge of the cam plate there is an arcuate cam face 56, with a cam groove or rope groove 58 running along its length in the circumferential direction. A rope or cable anchor is provided at the end of the groove 58. The cam plate may be formed of wood or wood laminate, or may favorably be formed of a suitable plastic composition or aluminum alloy. The cam members may have a constant radius, but for effective rowing simulation, true cam shapes (i.e., with a varying radius) may be used to load particular parts of the stroke. In the illustrated embodiment, the cam plates are shaped so as to load the catch phase of the stroke.

On an underside of each arm 42 is a cable guide wheel 60 that guides a cable or rope 62 (shown in dash lines in FIG. 1) as it leaves the groove 58 of the associated cam face 56.

At the underside of the transverse bar 36 there are mounted first and second guide wheels or pulleys 64 and 66 for defining the path of travel of the drive cable or cables 62, and another guide wheel 68 for the travel of an elastic cord or bungee cord, to be discussed later. A first multiplier pulley assembly 70, i.e., a 4:1 pulley multiplier, has a forward pulley member over which the cable 62 runs, and a set of chain pulleys. A second multiplier pulley assembly 72, i.e., a 4:1 pulley multiplier, has a forward anchor member and a set of chain pulleys. A drive chain 64 runs over the chain pulleys of these two multiplier assemblies 70 and 72, and a bungee cord 76 is anchored at one end to the anchor member of the multiplier assembly 72.

A flywheel 80, which is in the form of a centrifugal blower or fan, has a vertical axle mounted on a pivot suspension 82 that is attached to the underside of the proximal portion of the frame 12. There is a chain drive sprocket 84 coupled to the flywheel axle, which can include a one-way clutch for unidirectional rotary drive of the flywheel 80. The flywheel or fan has a number of backward angled blades or vanes. Not shown here is a shroud or cover provided as a safety measure to cover the rotary flywheel 80, and also to provide a more streamlined appearance to the machine.

Additional pulleys 86 are mounted on the frame 12 near the flywheel at the proximal end, and are used for the chain 74 and bungee cord 76, as illustrated in the schematic cable and chain run diagram of FIG. 9 (discussed below).

The rowing machine 10 of this embodiment can be folded down to a more compact form, e.g., for storing the machine between uses, and this configuration is shown in FIGS. 6, 7 and 8. When the rower is finished with his or her workout on the machine 10, the latch cams 45 are lifted to disengage the latches 44 on each of the horizontal arms 42. This allows the arms 42 to be pushed to rearward, i.e., proximally, until the arms 42 are placed alongside the respective left and right rails 14, 16, of the frame. The oars 50 are also aligned parallel to the arms 42 and the rails 14, 16. This positions the cam plates 54 to face towards the axle of the flywheel 80. As shown in FIG. 8, there is a spacing D defined between the top of the flywheel fan 80 and the underside of the rails of the frame 12. This spacing is greater than the thickness of the cam plate 54, so each cam plate slides easily into place in the space above the flywheel fan 80.

When the user desires to resume exercise rowing, it is a simple matter to swing the two arms 42 back out to the open position (FIGS. 2 to 5), and re-set the latches 44. Thus, in this embodiment the latches 44 serve as releasable latching means for holding the arms 42 in place in their extended positions for exercise use, but are adapted to release and thus permit the arms 42 to swing to their withdrawn position, i.e., storage position.

Figure 9:
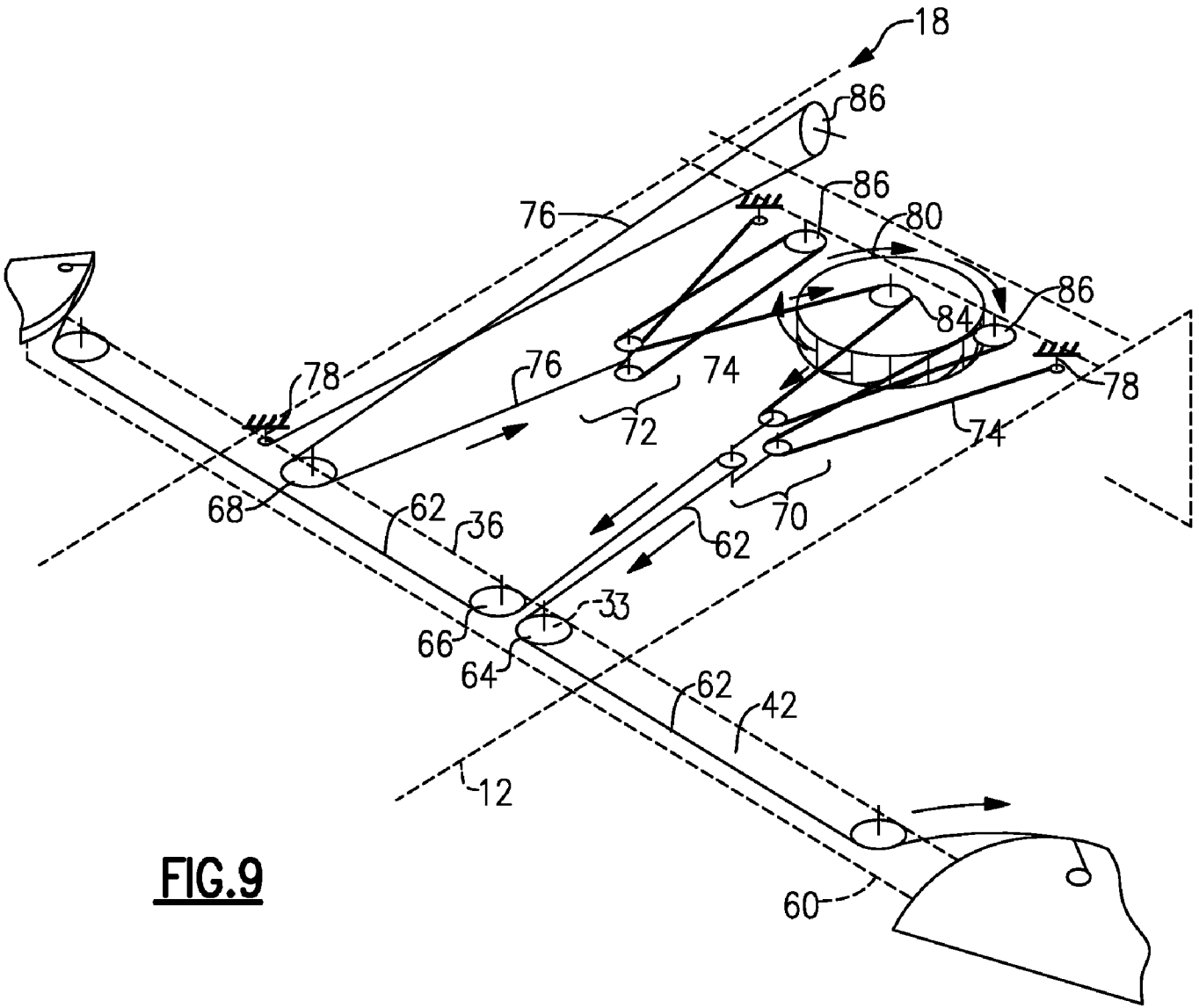
FIG. 9 is a schematic view illustrating the path of the drive cable, the drive chain and resilient cord for the rowing machine of this embodiment.

The arrangement of the power cables 62, drive chain 74 and elastic return cord or bungee cord 76 is shown in the schematic of FIG. 9. The arrows indicate the motion direction when the oars are being stroked or pulled. The frame 12 is shown here in broken line. Here, each of the two cam plates 54 serves as a yoke for pulling the cable 62 that runs between them. The cable 62 is anchored at its ends to the cam plates, and passes across the wheels 60, 64 and 66 to form a loop that passes around a cable wheel of the 4:1 pulley assembly 70. The elastic bungee cord 76 has one end connected to an anchor point 78 on the frame 12, and then extends in a folded path over pulley wheel 86 and pulley wheel 68, with the other end being anchored to an anchor point on the pulley assembly 72. The bungee cord 76 may be about sixty inches in length. The drive chain 74 has its two ends affixed to anchor points 78 at the proximal end of the frame 12, and has a path that passes over both chain pulley wheels of each of the pulley arrangements 70 and 72, over the two additional pulley wheels 86 at the proximal end of the frame, and over the sprocket wheel 84 of the flywheel 80. This arrangement achieves a motion advantage of 4:1 for the drive chain 74 in respect to the power cable 62 and also in respect to the cord 76. This 4:1 drive ratio permits the yokes or cam plates 54 to be much smaller than the corresponding cam of the earlier exercise rower as shown in U.S. Pat. No. 4,743,011, and thus the cams so dimensioned fit between the rails and the flywheel axle when the machine is folded down. The machine of this embodiment has a multiplier effect of 4:1, but other ratios are possible, and a different ratio may be selected for matching the resistance of various types of flywheels and/or various cam radiuses. The multiplier device may be a pulley device, as employed in this embodiment, or may be a gear driven device or other multiplier, depending upon the design of the machine.

In this embodiment, the bungee cord 76 serves as a resilient return means for applying tension onto the power cable arrangement, against the stroke action of the oars.

In practice, the exercise rowing machine can be used with both oars (as shown in FIG. 1) for sculling motion. The user may employ one or the other of the oars, by itself, with the extension handle pulled out to a longer position, for a sweep motion. The rowing machine can be fitted with only a single arm for sweep rowing, and the arm may be attached onto either side of the frame, for simulating rowing port or rowing starboard as in, e.g., an eight-man shell. The oar used in sweep rowing is longer than the sculling oar, and the spread, i.e., distance out to the pivot or oar lock, is longer than in sculling, so it is preferred to use a larger sweep arm and a longer oar shaft when the machine is configured for sweep rowing exercise. The sweep arm would be a different part and the drive cord would be able to swing to either side of the machine and stay attached to the arm to serve as a port or starboard sweep-type exercise rowing machine.

The frame, seat, and oar assemblies may be made of an aluminum alloy or a suitable steel, or may be made in whole or in part of a modern plastic material, with suitable reinforcement.

While the invention has been described in detail with respect to one preferred embodiment, it should be recognized that there are many alternative embodiments that would become apparent to persons of skill in the art. Many modifications and variations are possible which would not depart from the scope and spirit of this invention, as defined in the appended claims.

I claim:

1. A fold-down exercise rowing machine comprising:

an elongated frame having a proximal end and a distal end, and left and right sides, with a pair of seat rail members extending at least a portion of the distance between the proximal and distal ends;

a foot plate mounted on the frame at the distal end thereof;

a rotary flywheel mounted at the proximal end of the frame below the seat rail members to rotate on a vertical axis, with a vertical spacing defined between the flywheel and the seat rail members, and including a drive sprocket;

a seat movably supported on the seat rail members and adapted to glide along said seat rail members;

a pair of arms that are pivotally connected onto the left and right sides of the frame, respectively, and are adapted to pivot between an extended position in which the arms protrude horizontally out from the frame and a withdrawn position in which the arms lie parallel to and alongside the frame;

fixed pivot members positioned at outer ends of said arms, respectively, to define vertical pivot axes;

left and right oar pivot members rotatably supported in said fixed pivot members;

left and right rower oar handle shafts affixed onto upper ends of said oar pivot members;

left and right cable pulling members mounted onto lower ends of said oar pivot members;

a power cable arrangement having ends anchored to said cable pulling members, respectively, and having a portion thereof winding around the drive sprocket of said flywheel for rotating said flywheel when a user is seated on said seat and strokes at least one of said oar handle shafts;

resilient return means for applying a tension onto said power cable arrangement against the stroke action of said at least one oar handle shaft;

releasable latch means for holding said arms in said extended position during exercise use of the machine, and adapted to release for permitting the arms to swing to their withdrawn position; and wherein said cable pulling members each have a thickness less than said vertical spacing, to permit said cable pulling members to fit between said flywheel and said seat rail members when the arms are in their withdrawn position.

2. The fold-down exercise rowing machine according to claim 1, wherein each of said arms includes a hinge member affixed to an inner end of the arm and to the respective side of said frame, and situated at a proximal side of the associated arm.

3. The fold-down exercise rowing machine according to claim 1, wherein each of said cable pulling members includes a cam member having an arcuate face containing a cable groove.

4. The fold-down exercise rowing machine according to claim 3, wherein each of said cam members is generally in the form of a sector of a disk with the cam face thereof being substantially an arc of a circle.

5. The fold-down exercise rowing machine according to claim 1, wherein said power cable arrangement includes a multiplier device, so as to impart a motion multiplier effect to said flywheel.

6. The fold-down exercise rowing machine according to claim 5, wherein said multiplier device includes a multiplier pulley situated between said cable pulling members and the portion of the cable arrangement winding around the drive sprocket, and imparts a multiplier effect of 4:1.

7. The fold-down exercise rowing machine according to claim 1, wherein said return means includes an elastic member anchored to said frame, and a multiplier pulley connected between said elastic member and said portion winding around said drive sprocket.

8. The fold-down exercise rowing machine according to claim 1, wherein said flywheel includes a centrifugal blower wheel having vanes distributed around the vertical axis thereof.

9. The fold-down exercise rowing machine according to claim 1, comprising at least one pulley mounted on each of said left and right arms adjacent the associated one of said cam members, and wherein said power cable arrangement has left and right flexible inextensible cables each traveling over said at least one pulley to the associated cable pulling member.

10. The fold-down exercise rowing machine according to claim 1, wherein said portion of said drive cable assembly includes a drive chain.

11. A fold-down exercise rowing machine comprising:

an elongated frame having a proximal end and a distal end, and left and right sides, with a pair of seat rail members extending at least a portion of the distance between the proximal and distal ends;

a foot plate mounted on the frame at the distal end thereof;

a rotary flywheel mounted at the proximal end of the frame below the seat rail members to rotate on a vertical axis, with a vertical spacing defined between the flywheel and the seat rail members, and including a drive sprocket;

a seat movably supported on the seat rail members and adapted to glide along said seat rail members;

an arm that is pivotally connected onto one of the left and right sides of the frame, and is adapted to pivot between an extended position in which the arm protrudes horizontally out from the frame and a withdrawn position in which the arm lies parallel to and alongside the frame;

a fixed pivot member positioned at an outer end of said arm to define a vertical pivot axis;

an oar pivot member rotatably supported in said fixed pivot member;

an oar handle shaft affixed onto an upper end of said oar pivot member;

a pulling member mounted onto a lower end of said oar pivot member;

a power cable arrangement having an end anchored to said cable pulling member, and having a portion thereof winding around the drive sprocket of said flywheel for rotating said flywheel when a user is seated on said seat and strokes said oar handle shaft;

resilient return means for applying a tension onto said power cable arrangement against the stroke action of said oar handle shaft;

releasable latch means for holding said arm in said extended position during exercise use of the machine, and adapted to release for permitting the arm to swing to its withdrawn position; and wherein said cable pulling member has a thickness less than said vertical spacing, to permit said cable pulling member to fit between said flywheel and said seat rail members when the arm is in the withdrawn position.

12. The fold-down exercise rowing machine according to claim 11, wherein said arm includes a hinge member affixed to an inner end of the arm and to the associated side of said frame, and situated at a proximal side of the arm.

13. The fold-down exercise rowing machine according to claim 11, wherein said cable pulling member includes a cam member having an arcuate face containing a cable groove.

14. The fold-down exercise rowing machine according to claim 13, wherein said cam member is generally in the form of a sector of a disk with the cam face thereof being substantially an arc of a circle.

15. The fold-down exercise rowing machine according to claim 11, wherein said power cable arrangement includes a multiplier device situated between said cable pulling member and the portion of the cable arrangement winding around the drive sprocket, so as to impart a motion multiplier effect to said portion.

* * * * *